United States Patent [19]

Anderson

[11] 4,081,348

[45] Mar. 28, 1978

[54] ELECTROLYTIC CELL LINER AND SEAL DEVICE

[75] Inventor: Ralph Francis Anderson, Akron, Ohio

[73] Assignee: The B. F. Goodrich Company, Akron, Ohio

[21] Appl. No.: 802,221

[22] Filed: Jun. 1, 1977

[51] Int. Cl.[2] ..... C25B 9/00; C25B 13/02

[52] U.S. Cl. ..... 204/242; 204/252; 204/279

[58] Field of Search ..... 204/242, 252, 279

[56] References Cited

U.S. PATENT DOCUMENTS

| | | | |
|---|---|---|---|
| 2,392,868 | 1/1946 | Stuart | 204/252 |
| 3,342,717 | 9/1967 | Leduc | 204/252 X |
| 3,707,454 | 12/1972 | Loftfield et al. | 204/242 |
| 3,857,775 | 12/1974 | Custer et al. | 204/242 X |
| 4,028,209 | 6/1977 | Labedan et al. | 204/279 X |

*Primary Examiner*—John H. Mack
*Assistant Examiner*—D. R. Valentine
*Attorney, Agent, or Firm*—Harry F. Pepper, Jr.; W. A. Shira, Jr.

[57] ABSTRACT

A cell liner for an electrolytic cell which covers the base plate of the cell is adapted to provide an effective seal between the base plate and the cover of the cell. Around the perimeter of the liner extends a sealing device having two parallel ribs defining a channel for receiving an elongated elastomeric extrusion of circular cross-section. The extrusion is adapted to sealably contact the sealing rim of the top cover.

5 Claims, 5 Drawing Figures

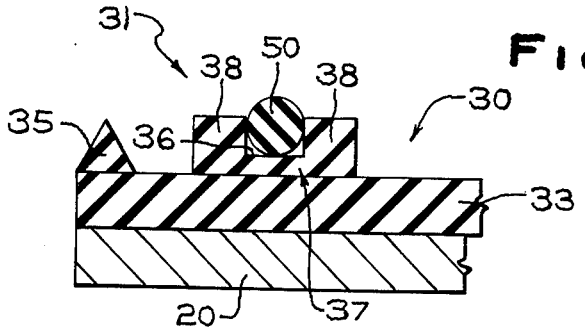
FIG. 3
FIG. 4
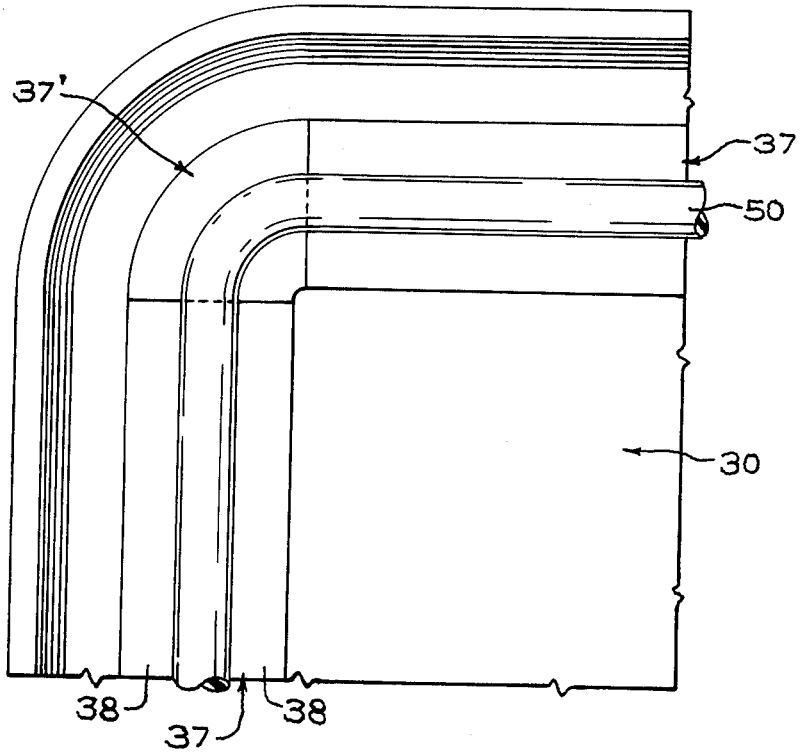
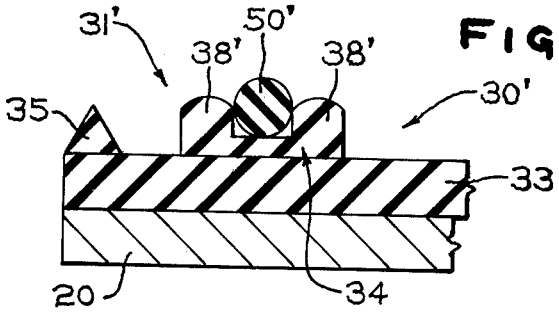
FIG. 5

ELECTROLYTIC CELL LINER AND SEAL DEVICE

BACKGROUND OF THE INVENTION

This invention relates to electrolytic cells and more particularly to the effective sealing of such cells.

Electrolytic processes are well known in many industrial branches of electro-chemistry. In the chlor-alkali industry, for example, electrolytic processes used for producing chlorine comprise passing an electric current through a brine solution, which decomposes to form chlorine and hydrogen gas and sodium hydroxide (caustic soda).

Various types of electrolytic cells have been developed to accomplish this reaction. Two of the most widely employed types are the mercury cell and the diaphragm cell. In a diaphragm cell, brine is introduced into an anode compartment and flows through a diaphragm into a cathode compartment. Chlorine is formed at the anode and hydrogen and caustic soda at the cathode. The diaphragm prevents the caustic from diffusing into the anode compartment and the two gases are carried away through separate discharge tubes.

Diaphragm type electrolytic cells generally comprise a cover assembly and a base plate upon which the cover assembly rests. The cover assembly with the base plate hermetically encloses the electrolysis zone. A series of spaced anodes are rigidly affixed to the base plate. A series of spaced cathodes is usually rigidly affixed or held within the cover and interleaves or nests with the base assembly anodes when the cover assembly is placed upon the base plate.

The base plate is usually made of copper and is covered by an impermeable cell liner which prevents the electrolytic solution or "anolyte" surrounding the anodes from contacting the base plate. This protection is required because the copper base plate would rapidly be corroded upon exposure to the anolyte solution.

The anodes in a diaphragm type cell are usually attached to the copper base plate by means of stems or rods which are bolted into the base plate and extend through the cell liner to the anodes. The anode stems are often coated with a substance, such as titanium, to resist corrosion. Each stem has a collar which is adapted to be secured against the cell liner to prevent anolyte leakage onto the base plate through the stem holes in the liner.

The cover assembly of the cell is adapted to fit over the base assembly and to form a seal with the cell liner covering the base plate. This seal is often effected by an endless elastomeric rib-like projection extending around the perimeter of the cell liner and which sealably contacts the lower edge of the cover assembly when positioned upon the base plate. This rib-like projection usually is semi-circular in cross-section and is affixed to the cell liner surface by suitable means such as an adhesive.

Because this rib-like sealing member can take a permanent set after a period of time and thereby lose its effectiveness as a seal, the seals are usually changed at prescribed intervals. When changing this seal, however, because the sealing member is affixed to the surface of the liner, the entire liner is replaced.

SUMMARY

A cell liner for a diaphragm type electrolytic cell has an elastomeric sealing channel for effecting a fluid-tight seal between the base plate and the cell cover. The sealing device extends around the periphery of the liner and is generally parallel to the perimeter edge of the liner. The channel comprises two generally mutually parallel endless ribs spaced a predetermined distance apart. The space between the two ribs is adapted to receive an extrusion of circular cross-section which is not secured or adhered to the cell liner. The rim or edge of the cover assembly will contact the elastomeric extrusion to effect a seal. When changing or replacing a seal, the elastomeric extrusion is simply lifted out of the sealing channel and replaced with a new extrusion rather than replacing the whole cell liner.

BRIEF DESCRIPTION OF THE DRAWINGS

FIG. 3 is a cross-sectional view of a portion of the peripheral margin of the cell liner of FIG. 2.

FIG. 4 is a top view of one corner portion of the cell liner of FIG. 2.

FIG. 5 is a cross-sectional view of a portion of the peripheral margin of a cell liner made in accordance with an alternative embodiment of the present invention.

DETAILED DESCRIPTION OF A PREFERRED EMBODIMENT

Figure 1:
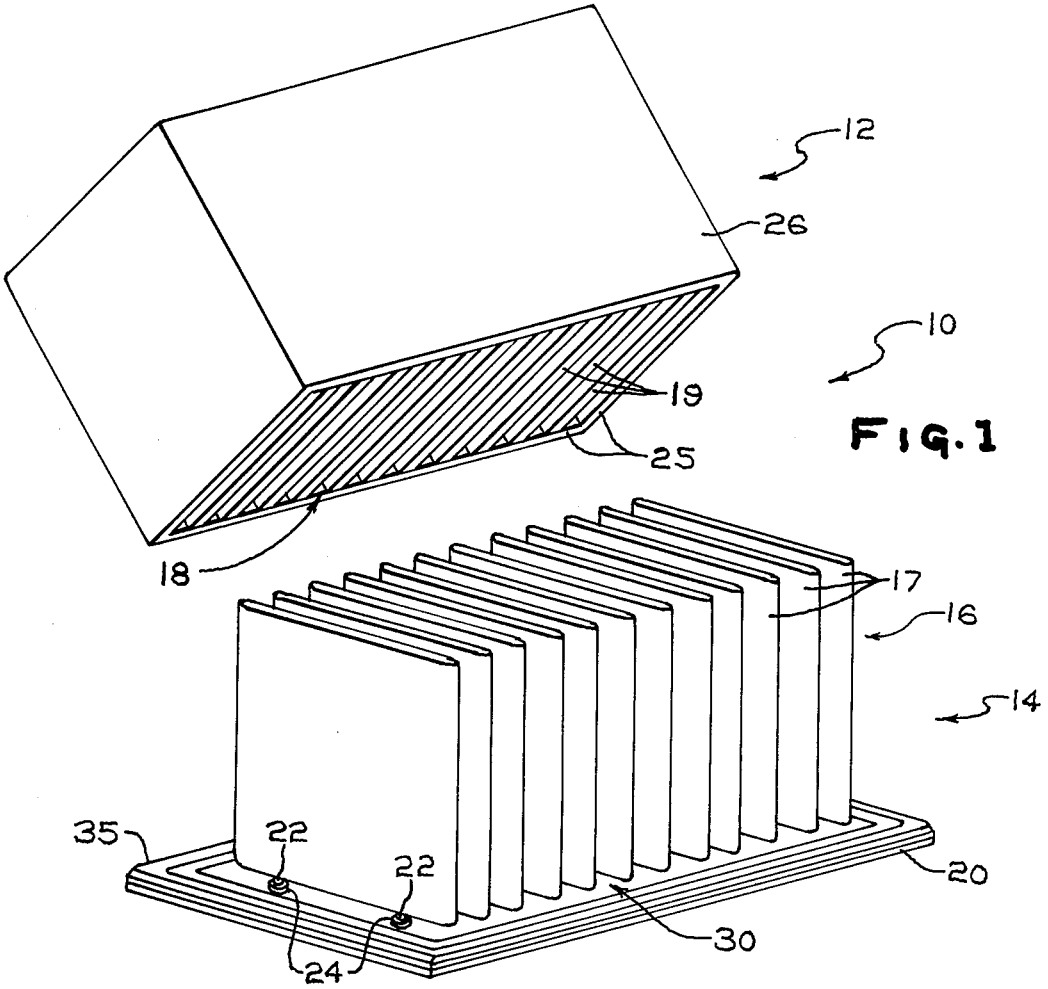
FIG. 1 is an isometric view of an electrolytic cell with cell liner utilizing a sealing device of the present invention.

FIG. 1 represents an electrolytic cell 10 of the diaphragm type used in the chlor-alkali industry for the production of chlorine. The cell 10 is comprised generally of an upper portion 12 and a lower portion 14. The cell 10 is shown in an opened position in FIG. 1, with the upper portion 12 being raised from the lower portion 14.

The lower portion 14 includes an anode assembly 16 and a copper base plate 20 covered by an elastomeric cell liner 30. The anode assembly comprises a series of spaced, dimensionally stable anodes 17 each of which are rigidly secured to base plate 20. The base plate 20 is adapted to supply electrical current to the anodes 17 from a suitable electrical power source (not shown).

Each anode 17, which may, for example, be an open mesh grid made of metal treated to resist corrosion, is rigidly connected to the base plate 20 by two titanium coated anode stems 22. Each stem 22 is fitted with a titanium coated locknut or collar 24 for effecting a proper seal with the cell liner 30. The stems 22 may have a threaded end portion for engagement with the base plate 20.

The upper portion 12 of cell 10 includes a cathode assembly 18 held within a cell enclosure or cover member 26. The cathode assembly 18 comprises a series of cathodes 19 which are spaced within cover member so as to interleaf with anodes 17 of anode assembly 16 when the upper cell portion 12 is joined to the lower cell portion 14. The cathodes 19 are typically of steel screen material and are each usually encased by a diaphragm member (not shown). A typical diaphragm is made to encase a cathode by depositing an asbestos fiber slurry upon a cathode. There are several other types of diaphragm materials known in the industry, it being understood that the particular anode, cathode and diaphragm structures specified herein are for illustration and are not considered critical to the present invention.

The enclosure or cover member 26 has a lower edge or rim 25 which seals the cell along the outer margins of base plate 20. The cell cover 26 typically features a product discharge exit tube (not shown) for removing the evolved product gas from the cell.

Figure 2:
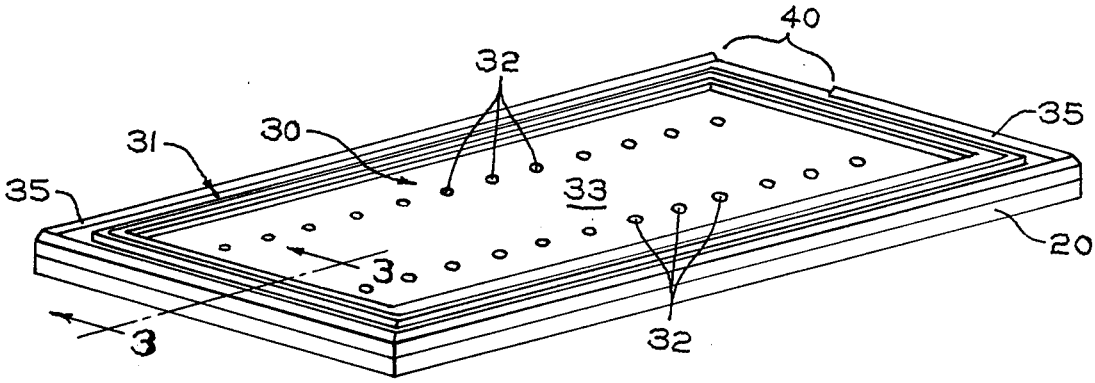
FIG. 2 is an isometric view of a cell liner used in the cell illustrated in FIG. 1.

The cell liner 30 which covers base plate 20 is more clearly shown in FIG. 2. The liner 30 is basically a vulcanized rubber sheet 33 sized to completely cover the upper surface of base plate 20. The central zone of the sheet 30 includes suitably arranged openings 32 for passage therethrough of anode stems 24 which secure and electrically connect the anode assembly 16 to base plate 20. The stem collars 24 hold the edges of opening 32 against base plate 20 in a sealed relationship.

Adjacent the outer margins of sheet 33, the cell liner includes an outer upwardly projecting elastomeric rib 35 extending almost entirely around the sheet 33. This rib, sometimes known as a "drip strip", is adhered in suitable fashion to the surface of sheet 33 and functions to direct any spillage, leakage or condensate to an open area 40 for collection by suitable means (not shown). The drip strip 35, as shown in FIGS. 3 and 5, can be triangular in cross-section, or may be some other desired contour such as semi-circular, or rectangular.

The cell liner 30, as seen in FIG. 3, further includes a sealing device 31 adhered to the surface of sheet 33 disposed in spaced relation to and inwardly of drip strip 35 and extending substantially parallel thereto. The device 31, as seen in FIGS. 3 and 4 includes a sealing channel 37, generally of U-shaped cross-section having spaced upwardly projecting legs 38 and an intermediate seat area 36. The channel 37 could be a one-piece member as shown or could be sections of different thickness rubber mutually adhered to achieve the channel contour. The spacing between legs 38 of channel 37 should be less than the width of sealing rim 25 of cover 26 and preferably is such to snugly receive an elastomeric sealing strip or extrusion 50 of such cross-section that it will project slightly above the upper surfaces of legs 38 of channel 37 when placed in channel member 37.

The extrusion 50 is preferably of circular cross-section as shown in FIG. 3, but can, if desired, be an alternative contour such as semi-circular. The extrusion 50 is of sufficient length to extend within and throughout the entire length of channel member 37 which is shown endless in FIG. 2. While the channel member 37 is adhered to the cell liner, the extrusion is not adhered to the cell liner either directly or indirectly as by adherence to channel seat 36. Thus, when need to change or replace a seal arises, one need only to lift the extrusion 50 from channel 37 and easily replace it with a fresh one.

It is preferred that the seal strip 50 be an extruded member for ease of fabrication. Also, it should be softer than the channel 37. It may differ from channel 37 in composition or be of the same composition. A 60 durometer, shore A hardness for channel 37 has been found satisfactory.

Also for ease of fabrication, it is preferred that channel member 37 be formed by extrusion. However, because of the corner sections necessary, it may be necessary to form an arcuate member 37' for each corner, as seen in FIG. 4, separately from the remaining straight length sections of channel member 37 by procedures other than extrusion (e.g. molding). In such case, an arcuate section 37' would interface with the straight line extruded portions of channel 37 along lines 39 (see FIG. 4) and be cemented or otherwise suitably adhered thereto.

In FIG. 5, an alternative embodiment in accordance with the invention is shown. A portion of a cell liner 30' includes a sealing device 31' having an elastomeric extrusion 50', similar to the extrusion 50 described above, positioned in a different sealing channel member 34. The channel member includes spaced legs 38', which differ from previously described legs 38 in that the upper surfaces of legs 38' are rounded rather than flat. This style of channel has been found particularly effective in the event the extrusion 50 deforms and takes a permanent set.

Cell 10 is closed by uniting upper portion 12 to lower portion 14 with anode and cathode assemblies 16 and 18 properly interleaved. When placing portion 12 on portion 14, rim or edge 25 of cover 26 contacts the sealing strip or extrusion 50 disposed in the sealing channel, such as 37, secured to cell cover sheet 33. The extrusion deflects and fills the spaces between channel legs 38 of channel 37 and when upper portion 12 and lower portion 14 are locked together by suitable means (not shown) an effective seal is created for electrolytic cell 10. When opening the cell, upper portion 12 is lifted from lower portion 14 and the seal may be replaced by removing the extrusion from the sealing channel and replacing the same with a fresh extrusion.

Although the foregoing structure is for the purpose of illustrating the invention according to a presently preferred embodiment, it should be evident that modification and alterations are possible without department from the scope of the invention as measured by the following claims.

I claim:

1. In an electrolytic cell having upper and lower separable portions, wherein said upper portion includes a cathode assembly held within a cell cover, said lower assembly includes an anode assembly connected to a base plate protected by a cell liner; and said cell liner includes an elastomeric sheet and an elastomeric sealing device disposed for contact with a lower portion of the cell cover to seal the cell, the improvement wherein said sealing device comprises A. an elastomeric sealing channel adhered to said elastomeric sheet, said sealing channel having upwardly spaced projecting legs and a seat between said legs, and B. an elastomeric extrusion of circular cross-section disposed within said channel on said seat such that the lower portion of said upper assembly will contact said extrusion to seal the cell when the upper and lower assemblies are joined.

2. The improvement defined in claim 1, wherein said channel is an endless member.

3. The improvement defined in claim 1 wherein said extrusion is an endless member.

4. The improvement defined in claim 2 wherein said extrusion is an endless member.

5. The improvement defined in claim 1 wherein the channel member has a shore A hardness greater than said extrusion.

* * * * *